US008006443B2

(12) United States Patent
Fuccella et al.

(10) Patent No.: US 8,006,443 B2
(45) Date of Patent: Aug. 30, 2011

(54) INTERLOCKING MODULAR FLOOR TILE

(75) Inventors: Daniel C. Fuccella, Cary, NC (US); Douglas E. Alexander, Raleigh, NC (US)

(73) Assignee: Tennessee Mat Company, Inc., Smyrna, TN (US)

( * ) Notice: Subject to any disclaimer, the term of this patent is extended or adjusted under 35 U.S.C. 154(b) by 1032 days.

(21) Appl. No.: 11/062,367

(22) Filed: Feb. 22, 2005

(65) Prior Publication Data

US 2005/0252109 A1 Nov. 17, 2005

Related U.S. Application Data

(60) Provisional application No. 60/546,357, filed on Feb. 20, 2004.

(51) Int. Cl.
*E04B 5/00* (2006.01)

(52) U.S. Cl. ..... 52/177; 52/591.1; 52/592.1

(58) Field of Classification Search ..... 52/177, 52/180, 581, 591.1, 591.3, 591.2, 592.1; 404/36, 41
See application file for complete search history.

(56) References Cited

U.S. PATENT DOCUMENTS

| | | | | |
|---|---|---|---|---|
| 3,802,144 | A | 4/1974 | Spica | |
| 3,909,996 | A | 10/1975 | Ettlinger, Jr. et al. | |
| 4,054,987 | A | 10/1977 | Forlenza | |
| 4,287,693 | A | 9/1981 | Collette | |
| 4,436,779 | A | 3/1984 | Menconi et al. | |
| 4,468,910 | A | 9/1984 | Morrison | |
| 4,497,858 | A * | 2/1985 | Dupont et al. | 404/41 |
| 4,584,221 | A | 4/1986 | Kung | |
| 4,590,731 | A * | 5/1986 | DeGooyer | 52/581 |
| 4,860,510 | A | 8/1989 | Kotler | |
| 4,930,286 | A | 6/1990 | Kotler | |
| 5,052,158 | A | 10/1991 | D'Luzansky | |
| 5,215,802 | A | 6/1993 | Kaars Sijpesteijn | |
| 5,364,204 | A * | 11/1994 | MacLeod | 52/180 |
| 5,630,304 | A | 5/1997 | Austin | |
| 5,791,114 | A | 8/1998 | Mandel | |
| 5,907,934 | A | 6/1999 | Austin | |
| 5,950,378 | A | 9/1999 | Council et al. | |
| 6,026,625 | A | 2/2000 | Austin | |
| 6,098,354 | A | 8/2000 | Skandis | |
| 6,332,941 | B1 | 12/2001 | Council et al. | |
| 6,451,400 | B1 * | 9/2002 | Brock et al. | 52/177 |
| 6,505,444 | B1 | 1/2003 | Johnson | |
| 6,526,705 | B1 | 3/2003 | MacDonald | |
| 6,802,159 | B1 * | 10/2004 | Kotler | 52/177 |
| 7,114,298 | B2 * | 10/2006 | Kotler | 52/177 |
| 2002/0119275 | A1 | 8/2002 | Williamson | |
| 2002/0157331 | A1 | 10/2002 | Peart et al. | |

FOREIGN PATENT DOCUMENTS

EP 0382119 B1 2/1990

* cited by examiner

*Primary Examiner* — Robert J Canfield
*Assistant Examiner* — Matthew J Smith
(74) *Attorney, Agent, or Firm* — Stites & Harbison PLLC; Richard S. Myers, Jr.

(57) ABSTRACT

An interlocking, modular floor tile that comprises a planar member defined by a perimeter having four sides and a top surface, a plurality of downwardly projecting support legs of common length dispersed pattern-wise inside the perimeter of the planar member and coupled with the top surface, and at least one female interlocking connector element that extends outside the perimeter of the planar member for receiving a support leg of a like tile and thereby forming an interlock with the like tile.

37 Claims, 11 Drawing Sheets

10
25
10
25
25
10
25

10
25
10
10
25
25

INTERLOCKING MODULAR FLOOR TILE

PRIORITY INFORMATION

This patent application claims priority under 35 U.S.C. §119(e) of Provisional Patent Application No. 60/546,357 filed on Feb. 20, 2004, the contents of which are incorporated herein by reference.

FIELD OF THE INVENTION

The present invention relates to the field of modular floor tiles and modular floor tile systems, such as the modular floor tile systems that are installed on an existing floor. The present invention also relates to a connection system for modular floor tiles. The present invention further relates to a free standing modular mat system comprising at least two mats, or tiles.

BACKGROUND OF THE INVENTION

Modular floor tiles are often used as components on the construction of a flooring system. The system may be designed as a floor covering for an entire room, or a floor covering for a section if a room. The typical floor system components may be manufactured from, for example, semi-rigid, plasticized, virgin polyvinyl chloride, virgin/reclaimed polyvinyl chloride mixtures, or compression molded rubber.

The floor system is suitable to withstand inclement weather, harsh environments, heavy traffic, and resist damage when exposed to harsh chemicals. Primary uses for the modular floor tiles of the present invention include providing lateral support, and providing comfort and reduction of fatigue during walking or standing.

Various types of modular floor tiles have increased in popularity due to their versatility. A free-standing modular floor mat system typically provides a non-slip modular system that optionally is self-draining and has multiple configuration capabilities. Another demand often placed on work environments is that floor mats need to be easily configured and re-configured in the plane of a floor.

Prior art connectors for mat systems have used separate multiple connectors for attaching one modular mat to another. These separate connectors have not worked well in practice because they get lost or make alignment between adjacent mats difficult during reinstallations after lifting the modular mats out of the system.

The conventional modular floor tiles are not adjustable size-wise, which limit their usefulness with respect to custom sizes.

Some prior art floor tile provide connection devices around the periphery of the tile. In those tiles, a secure connection may be sacrificed where the tile must be trimmed. That is, modular tile systems built with these tiles do not provide a secure fitting if trimmed to adjust size.

Other prior art mats have required separate connectors, which limit their versatility. These systems have disadvantages because the connectors may get lost or make proper alignment between adjacent mats difficult during installation or reinstallation.

An example of an existing modular floor mat system is U.S. Pat. No. 6,505,444, to Johnson. The '444 patent discloses a free standing modular mat system for creating various selectable combinations of mat configurations by using first and second mats having parallel ribs on the bottom and parallel spaced ribs on the top at right angles to the bottom ribs, and having top and bottom connectors having inter-engaging mating grooves.

U.S. Pat. No. 5,630,304, to Austin, discloses a quadrilateral floor tile having a downward sloping edge. Two of the sides are formed with integral interlocking strips, with a cavity positioned to mate with a corresponding male connecting member of a neighboring tile.

U.S. Pat. No. 5,950,378, to Counsel et al., discloses a modular floor tile that may be used to construct athletic playing surfaces including basketball courts and tennis courts. These tiles comprise a top member made of relatively hard material and a bottom member made from resilient, impact absorbing material. Theses tiles comprise coupling loops about the periphery of the tile that engage posts, also located along the periphery of the tile.

U.S. Pat. No. 5,907,934 to Austin discloses an interlocking floor tile in the form of a right triangle, with each side having a row of female cavities located adjacent the sides and positioned to mate with a corresponding male connecting member of a neighboring tile.

U.S. Pat. No. 4,930,286 to Kotler discloses a modular tile for interlocking with other similar tiles that comprises a plastic support grid having a rectangular configuration bounded by a perimeter wall and including a repeating pattern of intersecting cross members with interstitial openings formed in-between. In this tile there are a plurality of support legs coupled to a base side of the cross junctions in general perpendicular orientation. Interlock structure is coupled to and extends outward from the perimeter wall to enable removable attachment with other modular tiles of similar design.

U.S. patent application Publication No. 2002/0119275 to Williamson discloses a mat system wherein the mats are comprises of a plurality if individual tiles that interlock along complementary edge portions.

OBJECTS AND SUMMARY OF THE INVENTION

One object of the present invention is to provide modular floor tile that can easily be modified to cover a floor of any size or shape, but still cooperatively interlock with another tile of the present invention.

Another object of the present invention is to provide a tile that is easily modified to various sizes, yet interlocks with another tile of the present invention, and provides friction and cushion to a user of the tile.

Another object of the present invention is to provide a method of modifying an interlocking floor tile by shearing or cutting a portion of the tile, with the tile still having interlockability with another tile of the present invention on the sheared side of the tile.

Another object of the present invention is to provide a modular tile system that can be adjusted in size, but maintain interlockability with like tiles of the present invention on all sides of the adjusted tile.

It is a further object of the present invention to provide a modular floor tile that is suitable as a floor covering by absorbing lateral forces and offering traction, but is adjustable in size while maintaining interlockability with like tiles of the present invention.

One embodiment of the present invention is an interlocking, modular floor tile that comprises a planar member defined by a perimeter having four sides and a top surface, a plurality of downwardly projecting support legs of common length dispersed pattern-wise inside the perimeter of the planar member and coupled with the top surface, and at least one female interlocking connector element that extends outside the perimeter of the planar member for receiving a support leg of a like tile and thereby forming an interlock with the like tile.

Another embodiment of the present invention is a modular floor tile for interconnecting with similar modular floor tiles that comprises a support grid defined by a perimeter having four sides, a plurality of support legs of common length that are dispersed pattern-wise inside the perimeter and being coupled to the grid, and a plurality of female interlocking connector elements that extend outside the perimeter for receiving a support leg. The support grid may comprise intersecting cross members and may comprise a top surface.

Another embodiment of the present invention is a modular tile system of interlocking floor tiles that comprises at least two interlocked tiles, with said at least two interlocked tiles having a planar member that is defined by a perimeter having four sides and a width, the planar member having support legs of common length that are coupled to the planar member and pattern-wise dispersed within the perimeter of the planar member; and at least one interlock coupling device that extends beyond said perimeter and snugly receiving a support leg of a second tile, forming a continuous, generally uniform displacement gap between the perimeters of adjacent tiles. In typical embodiments, the displacement gap is minimal, or there may be a uniform, snug fit.

Another embodiment of the present invention is transition tile (or border tile) for a modular tile system that comprises a tile having a perimeter defined by a top surface, first, second, third, and forth side; a female connector extending beyond the perimeter of the first side of the perimeter; and support legs coupled with the top surface and dispersed pattern-wise from the first side to an opposite third side to receive a female member of a corresponding transition tile to form a snug interlock.

Another embodiment of the present invention is a method of constructing an interlocking tile floor covering. This embodiment comprises the steps of selecting at least two floor tiles with a planar member defined by a perimeter having four sides, a plurality of support legs of common length dispersed pattern-wise and coupled with the planar member, at least one female interlocking connector element that extends outside the perimeter of the planar member for receiving a support leg and thereby forming an interlock; interlocking said tiles by coupling the female connectors with a corresponding support leg; trimming a floor tile to correspond with the desired area desired to be covered, thus forming a trimmed floor tile; and interlocking a support leg of the trimmed tile with a corresponding female interlocking connector of another tile.

DETAILED DESCRIPTION OF THE INVENTION

Figure 1:
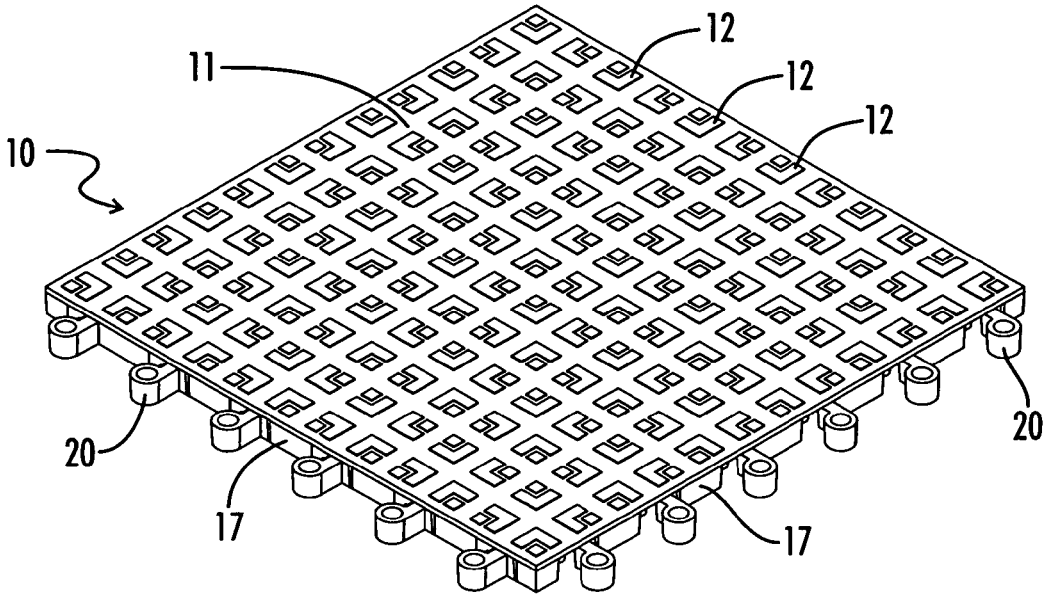
FIG. 1 is a perspective view of the top side of a tile constructed in accordance with the present invention. This embodiment shows a pattern of ridges or elevations to increase friction on the top surface of the tile.

For the purposes of this disclosure, a "mat" or "tile" shall be defined as a covering for the floor or ground. The terms should encompass those covering that have borders around the perimeter edges and also encompass those coverings in which the perimeter has been modified for installation into a recessed area in the floor such as a mat holding well.

The term "male" refers to pin or peg-type components. The term "female" refers to the components that have a socket or lug-type compartment that is sized and spaced to accommodate the "male" component. The "male" and "female" components are complimentary to one another in the sense that the "male" components may be securely inserted into the "female" components in a way that provides a mechanism for holding adjacent tiles to one another, as well as holding tiles to adjacent border strips (i.e. transition tiles). As described herein, "male" components may be used to assist in providing vertical support to the mat, whether coupled to a "female" component of an adjacent tile or not. Typically, all male components provide some type of vertical support to the mat.

A typical tile of the present invention may be manufactured by injection or compression molding, and typically comprise a thermoplastic material such as flexible or semi-rigid polyvinyl chloride or thermoplastic elastomer. Additionally a thermosetting plastic such as rubber may be used. Basically any material that is semi-rigid, semi-flexible, or elastomeric (e.g., flexible PVC, thermoplastic elastomers) that are capable of being injection molded can be used. Additionally, thermosetting rubbers and thermosetting elastomers capable of being compression molded can be used. The plastic or rubber should exhibit some degree of conformability so as to provide comfortable footing and facilitate trimming and mating of the tiles. Additionally, the material should exhibit a reasonable degree of structural integrity so as to support personnel and light industrial traffic. One of ordinary skill in the art can chose a material based on many desired characteristics of the resulting tile. For example, a material may be that is resistant to oils, greases, weak solvents, and chemicals typical of an industrial environment. A material may be chosen to exhibit a reasonably high coefficient of friction so as to reduce the risk of slipping. Additionally, embodiments of the present invention may also be conditioned to withstand inclement weather or other harsh environments, heavy traffic, and to resist damage when exposed to harsh chemicals. Example of the tiles of the present invention may be constructed using the material of prior art rubber mats described herein, as long as the use of such material will not negatively affect objects of the present invention.

In certain embodiments, the material used to manufacture the tiles of the present invention is resilient and impact-absorbing.

Additionally, the tiles of the present invention can be modified to include carpet strips, abrasive traction strips, absorption strips, abrasion traction coating, or the like.

Figure 2:
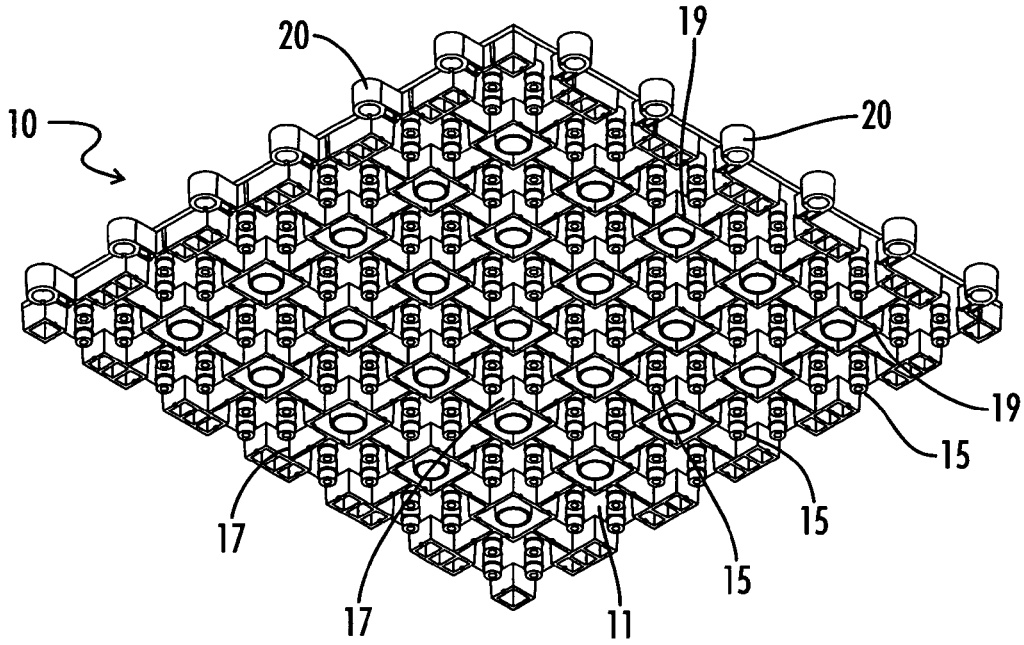
FIG. 2 is a perspective view of the bottom side of a tile constructed in accordance with the present invention. This embodiment shows support legs dispersed pattern-wise inside the perimeter of the tile and it shows a support grid.

As stated above, one embodiment of the present invention is an interlocking, modular floor tile that comprises a planar member defined by a perimeter having four sides and a top surface. FIGS. 1 and 2 shows such an interlocking, modular floor tile 10. The embodiment shown in FIG. 1 comprises a pattern of ridges or elevations 12 to increase friction on the surface, in this case the top surface, of the tile. However, these ridges and various top surface designs are optional and are not known to be critical. In embodiments of the present invention, the top planar surface, may comprise a friction promoting surface coated thereon, as well as or in place of ridges and/or apertures.

As shown in FIG. 2, this embodiment comprises a plurality of downward projecting support legs 15 which are dispersed pattern-wise inside the perimeter of the tile 10 and coupled with the top surface 11. Female interlocking connectors 20 that extend outside the perimeter of the planar member/modular floor tile 10 are shown. These female interlocking connector elements receive a support leg 15 of a like tile and thereby form an interlock with the like tile. The planar member 10 of this embodiment further comprises a support grid 17, which in this embodiment comprises cross member supports that extend inward from the perimeter and join at cross junctions along a common plane. These cross members 17 may form various patterns about the perimeter of the tile and function to assist in providing vertical support and strength to the tile. Circular supports can be seen in this embodiment as well.

Figure 20:
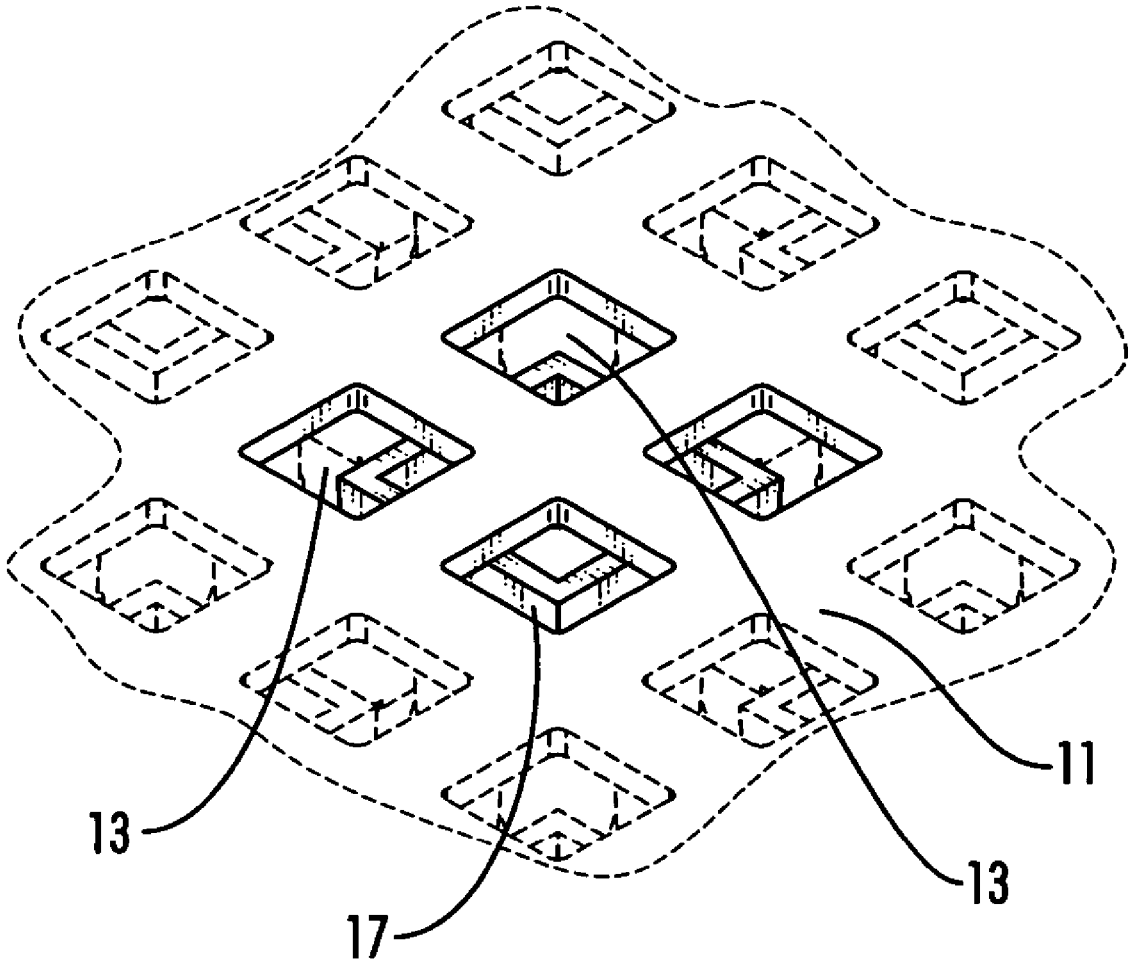
FIG. 20 shows a perspective view of a top surface part of a grid that defines a pattern of apertures. This embodiment may be more suitable for use during wet conditions, since the apertures allow water to drain from the surface of the tile.

In embodiments of the present invention, the top surface 11 may comprise any number of patterns of holes to allow the passage of air or a liquid. These tiles are especially suitable for wet working environments. See FIG. 20, which depicts an embodiment where the top surface 11 may defines apertures 13 to allow passage of air or a liquid through the tile.

The support legs 15 are positioned in the pattern such that the tile can be trimmed to a desired size and maintain connectability with female interlocking connectors 20 of a like tile 10. In certain embodiments, the support legs may be positioned such that the tile can be trimmed at approximately three-inch intervals and maintain connectability. This gives the tile of the present invention extreme versatility, size-wise, when being used as a modular tile system of various sizes and shapes.

As can be seen in FIGS. 1 and 2, the female interlocking connector elements, or lugs, 20 are positioned on two sides of the perimeter of the planar member. Accordingly, the corresponding support legs, or male connectors, or pins 15 may be positioned at least on the opposite sides of the tiles. In certain embodiments, such as the one shown in FIGS. 1 and 2, the male connectors are dispersed throughout the entire area. Where the male connectors are dispersed throughout the entire area, they are preferably dispersed in a pattern that accommodates trimming the tile in multiple locations, and still having at least one male connector in place to engage a lug of an adjacent tile.

The tiles 10 of the present invention may incorporate cut indicators perpendicular (or at other angles) from the perimeter to assist in trimming the tile. These cut indicators may be molded edges, grooves or nicks 19 in the support grid as shown in FIG. 2 or they may be other type of indicia such as markings.

In embodiments of the present invention, the support legs and/or support grid are ground-engaging to assist in providing vertical support to the grid and to the tile itself. The support legs and support grid are typically comprised of the same material as of the tile itself and are, in certain embodiments, resilient, impact-absorbing material.

The module tiles of the present invention maybe produced in multiple sizes. One advantage of the present invention is that multiple sizes may be used within the same modular tiles system, which may include edge pieces and corner pieces. Additionally, the modular tiles of the present invention may be cut or trimmed to enable proper fitting over the floor area to be covered. In embodiments, each side ranges from about 10" (inches) to about 30" (inches) in length. In other embodiments of the present invention, each side may range from about 15" (inches) to about 25" (inches) in length. The total dimension of the time is more dependent on the capability of the manufacturing equipment rather than the functionality of the tile. A manageable size that the inventors have determined works well as far as manufacturing and use are concerned is a time that is about 18" by about 18", not including lugs.

The modular tile of the present invention, as depicted in the figures, shows the support legs positioned throughout the area of the tile. Embodiments of the present invention include those where such support legs are positioned in rows to allow communication with corresponding female connectors of adjacent tiles. As depicted in the drawing, the female connectors appear on two sides of the tile. Corresponding support legs may appear on the opposite two sides of the tile, or may be positioned throughout the perimeter of the tile to provide additional size flexibilities should the tile be trimmed and to provide additional vertical support to the tile.

Figure 3:
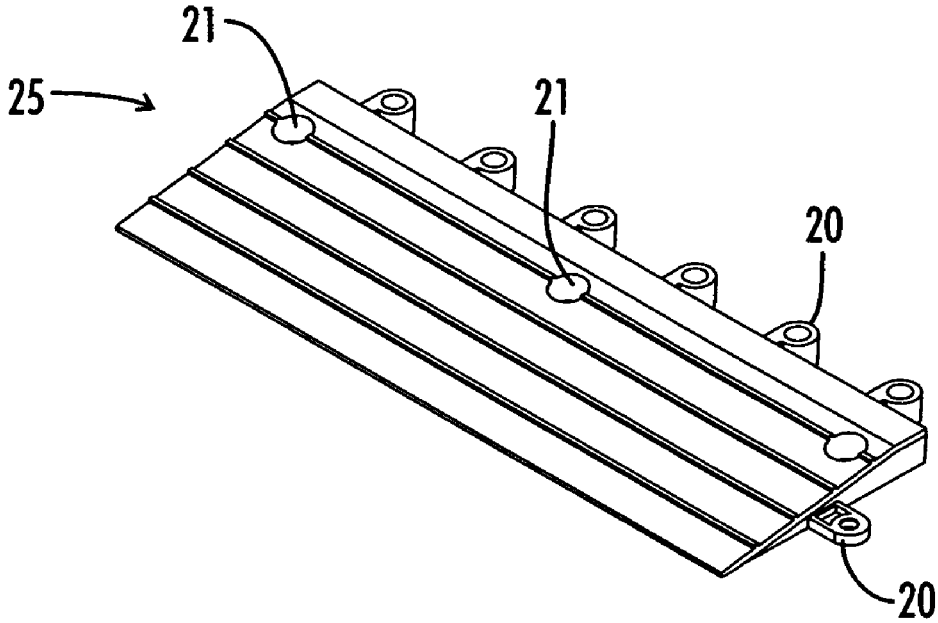
FIG. 3 is a perspective view of the top side of a transition tile of the present invention. This embodiment can connect with a tile such as the one described in FIG. 1.
Figure 4:
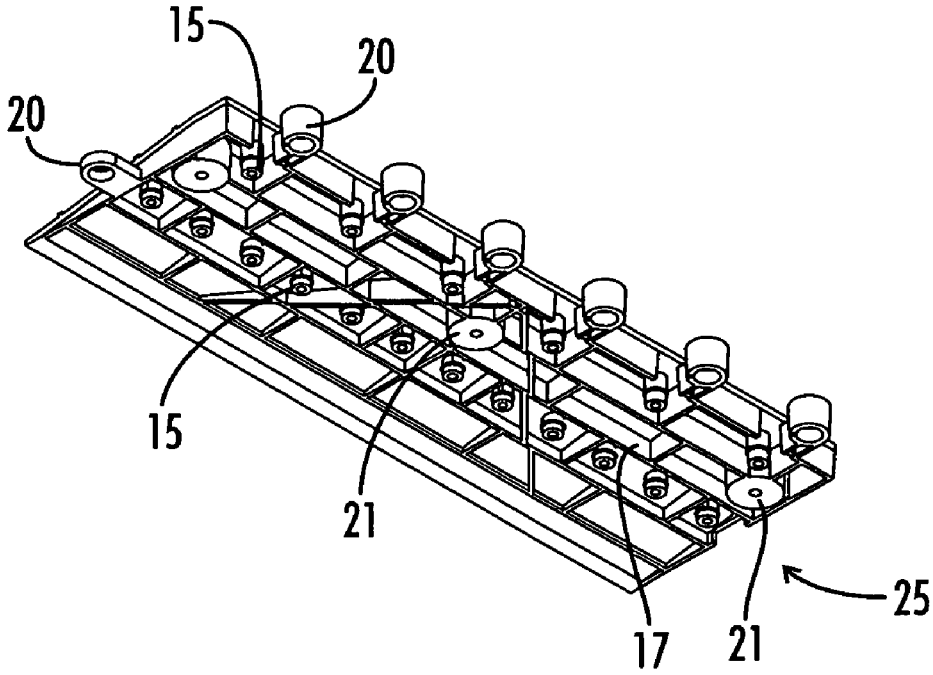
FIG. 4 is a perspective view of the bottom side of the tile of FIG. 3. It shows support legs coupled with the top surface and dispersed pattern-wise from a first side to an opposite side to receive a female member of a corresponding transition tile to form a snug interlock.
Figure 5:
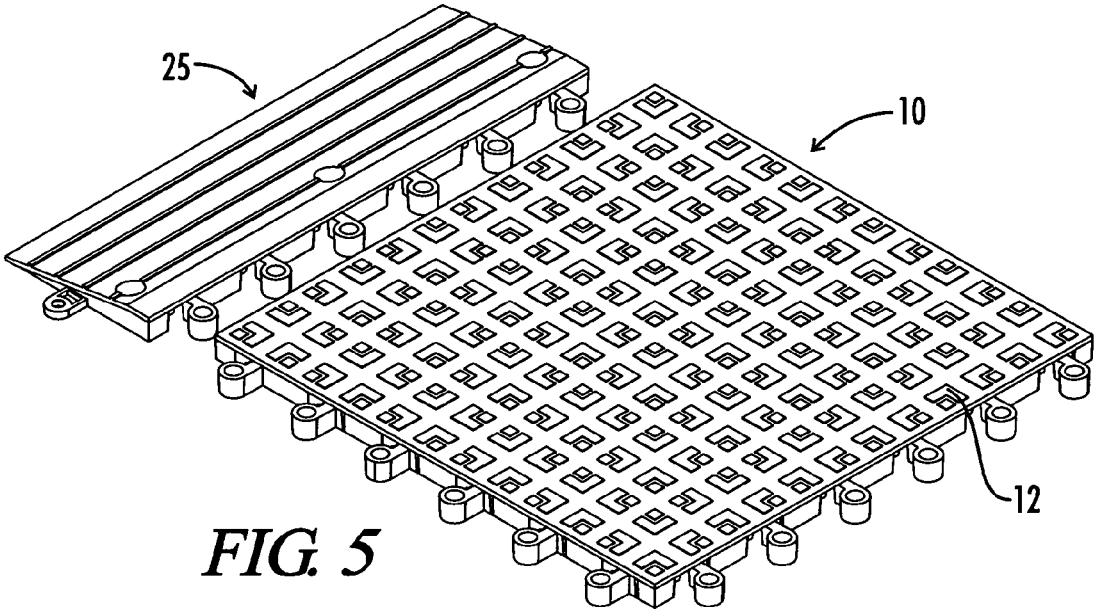
FIG. 5 is a perspective view of a transition tile and a tile constructed in accordance with the present invention as shown in FIG. 1. In this figure, the female connectors of the transition tile are in position to be received by the male connectors of the modular tile.
Figure 6:
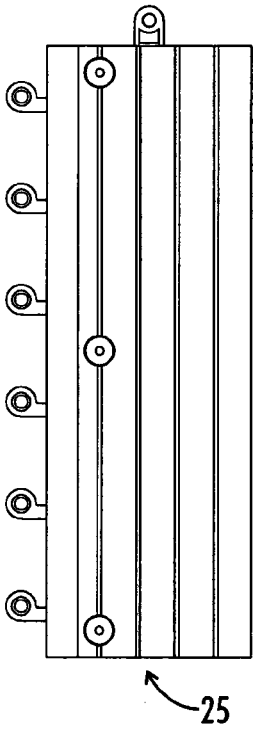
FIG. 6 is a top view of the transition tile of FIG. 3.
Figure 7:
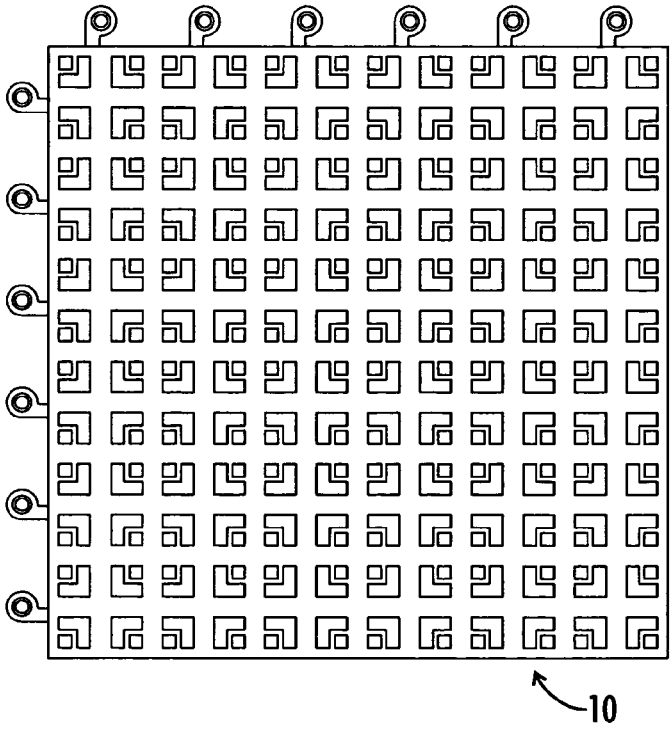
FIG. 7 is a top view of the modular tile of FIG. 1.

FIGS. 3, 4 and 6 show transition tiles or border tiles 25 of the present invention. These tiles are designed to communicate with the module tiles 10 such that the transition tiles finish a floor covering. These transition tiles have a perimeter defined by multiple surfaces and female connectors extending beyond the perimeter that may be used to couple with support legs to snugly combine two or more transition tiles together. As shown in FIG. 4, which is a view of the underside of a transition tile, support legs 15 are positioned to be received by the female connectors 20 attaching to transition tiles as well as support legs designed to communicate with the female connectors of the modular tiles 10. In the embodiment depicted in FIGS. 3 and 4, the female connectors that are adjacent to female connectors of a second modular tile or transition tile may be trimmed or removed to allow the remaining male connector 15 to communicate with the female connector of an adjacent tile. This feature provides enhanced flexibility with respect to designing a modular tile system with multiple tiles and multiple transition tiles.

The transition tiles may further comprise countersink holes 21 that allow one to more permanently attach the modular tile system to a floor area, if desired.

In additional embodiments, the transition tile is designed at an angle to provide a first height which is approximately equal to the height of a modular tile 10 and a second height that allows a smoother transition from the floor area that is covered to the height of the modular tile.

The transition tiles of the present invention may comprise a support grid to provide additional vertical support to the transition tile, and the support grid may comprise diagonal cross members 18. These diagonal cross members may be used as trimming guides when finishing corners of a mat system.

Figure 8:
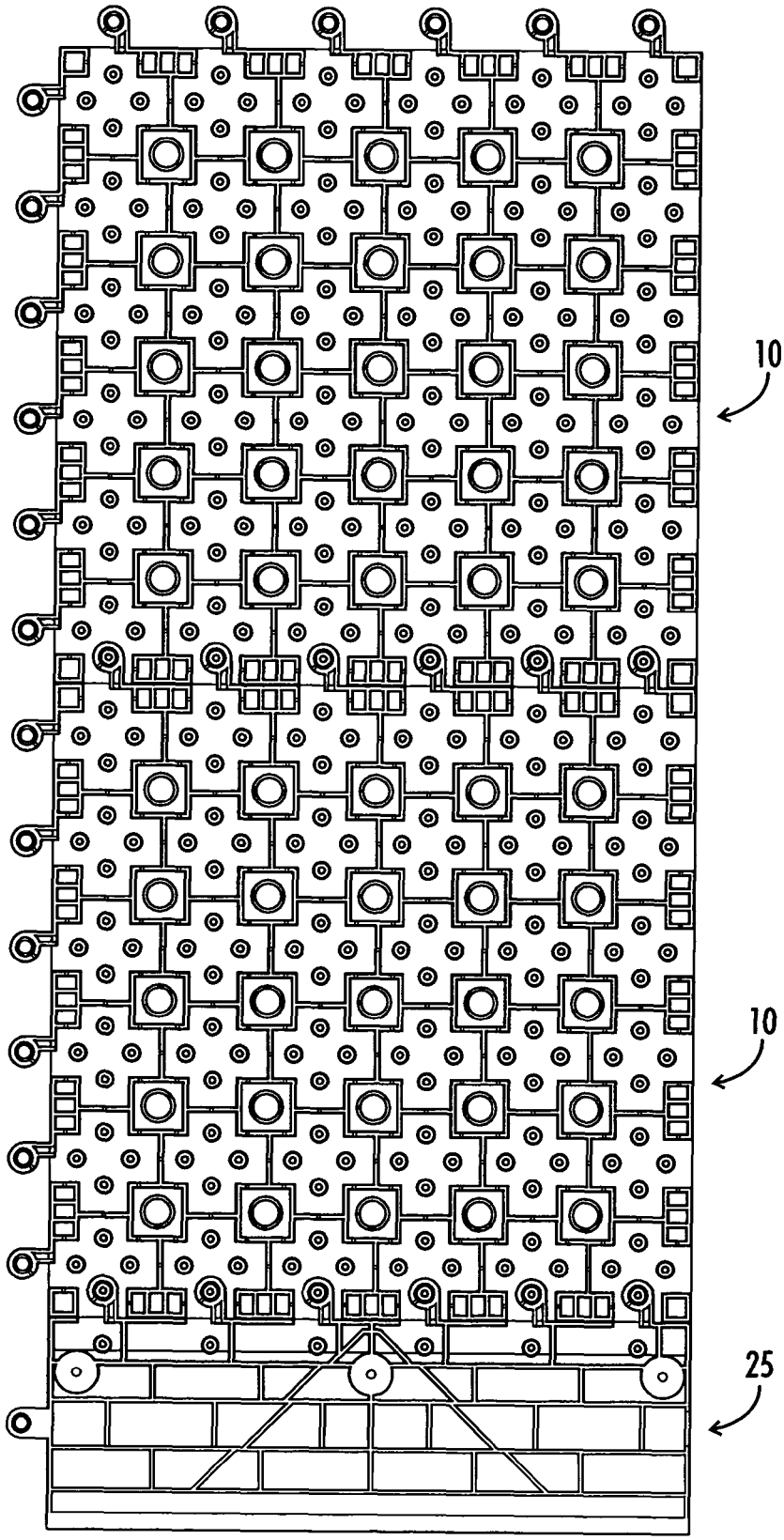
FIG. 8 is a bottom view that illustrates how multiple tiles of the present invention may be joined together to form a modular tile system. In this figure, two tiles, such as the ones shown in FIGS. 1 or 2 are joined with a transition tile such as the one shown in FIG. 3. The tiles form a continuous, generally uniform and snug displacement gap between the perimeters of adjacent tiles.
Figure 9:
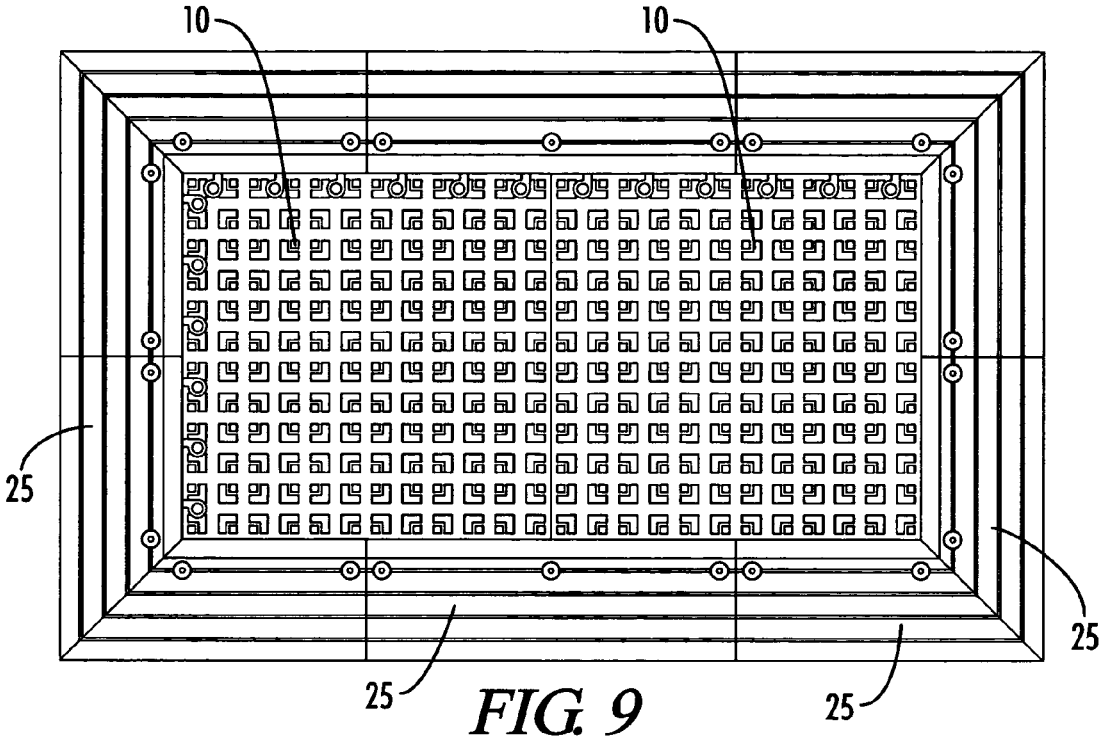
FIG. 9 shows a top view of a mat/tile/modular tile system of the present invention that incorporates multiple tiles such as those shown in FIG. 1 and transition tiles such as those shown in FIG. 3. In this embodiment, some of the transition tiles have been trimmed to allow snug completion of the transition tile area around a generally rectangular modular tile floor system.
Figure 10:
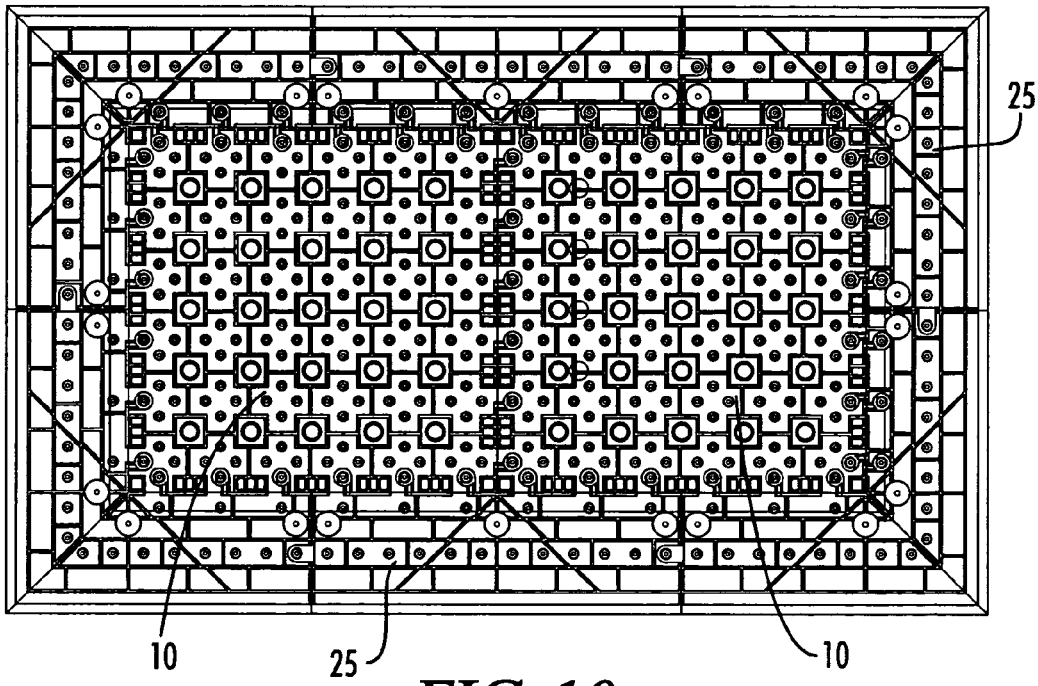
FIG. 10 is the bottom view of the system show in FIG. 9.
Figure 11:
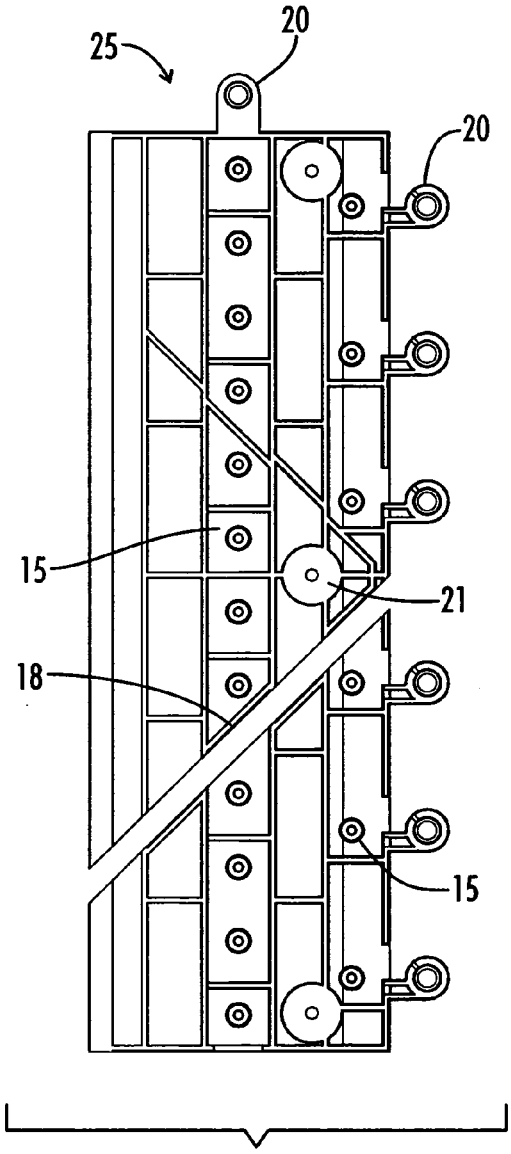
FIG. 11 shows a transition tile that is cut or trimmed to allow completion of a tile system. In the embodiment depicted in this figure, the shorter of the two pieces may be used for an interior corner and the longer piece may be used for an outside corner.
Figure 12:
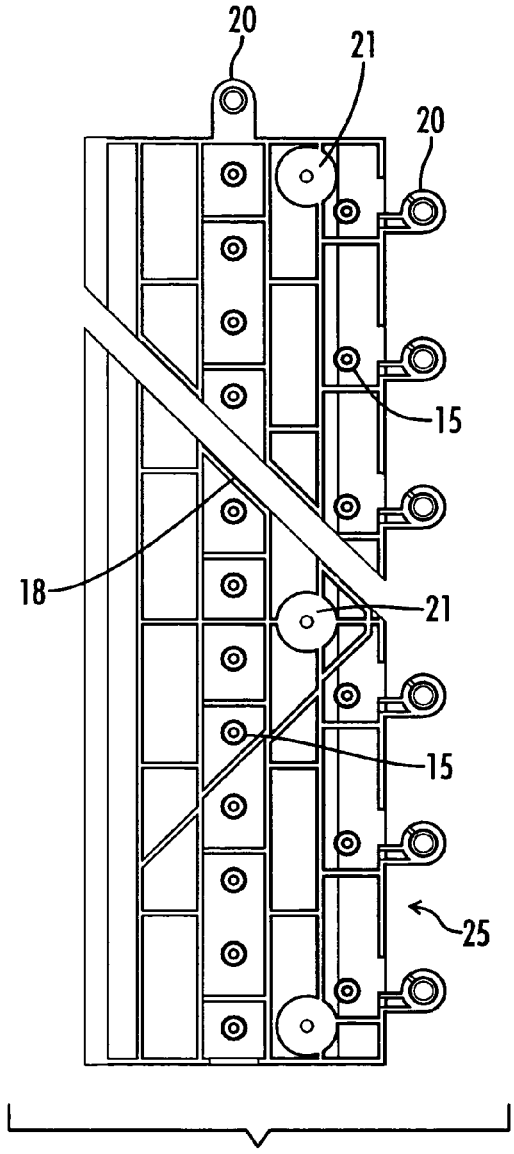
FIG. 12 shows a transition tile that has been cut or trimmed at an opposite angle as the one shown in FIG. 11.
Figure 13:
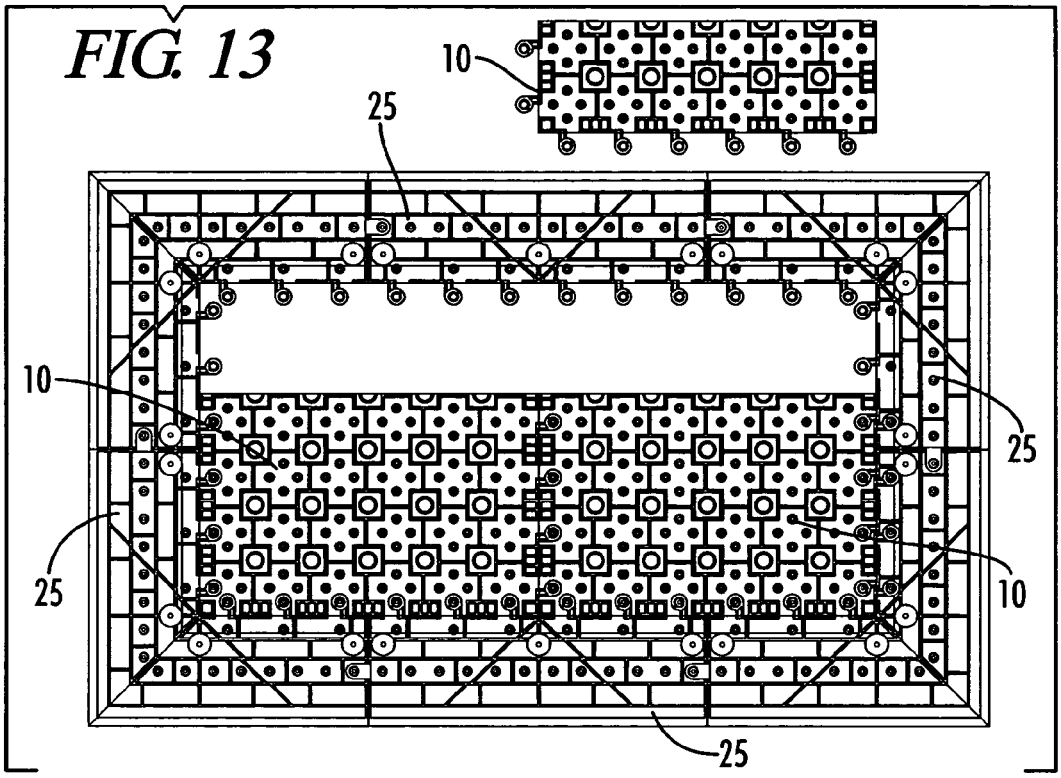
FIG. 13 shows a bottom view of a mat system of the present invention with a trimmed tile that can be interlocked with an assembly of tiles and transition tiles of the present invention.
Figure 14:
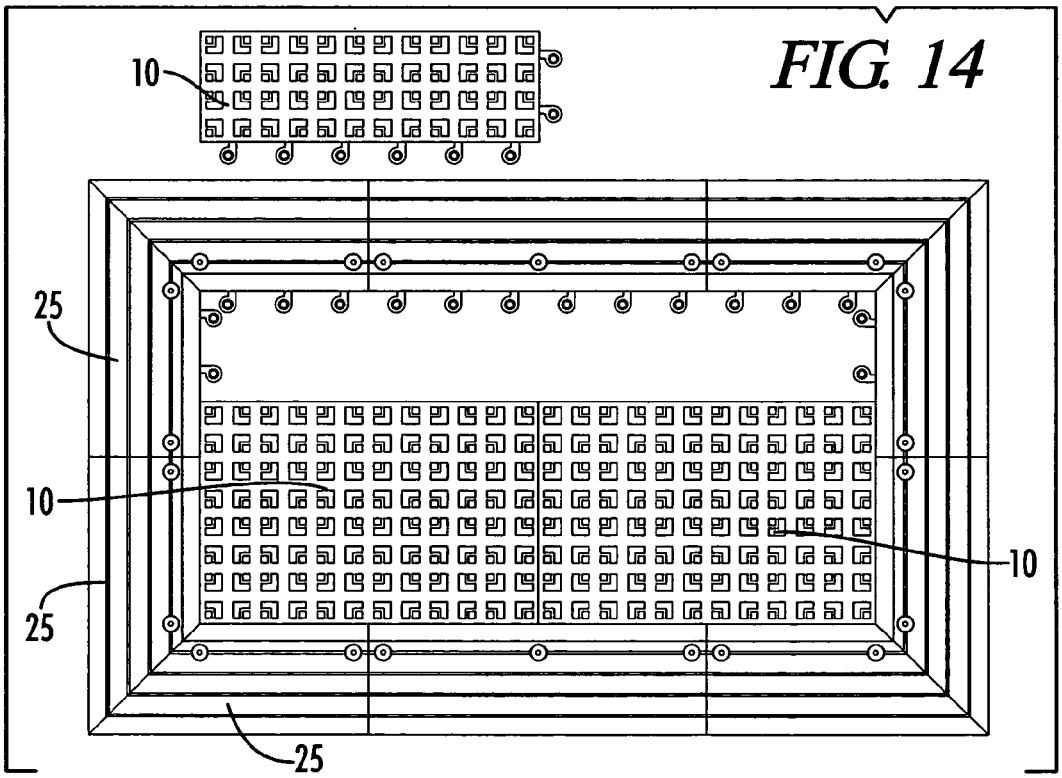
FIG. 14 is a top view of the tile assembly or system of FIG. 13.
Figure 15:
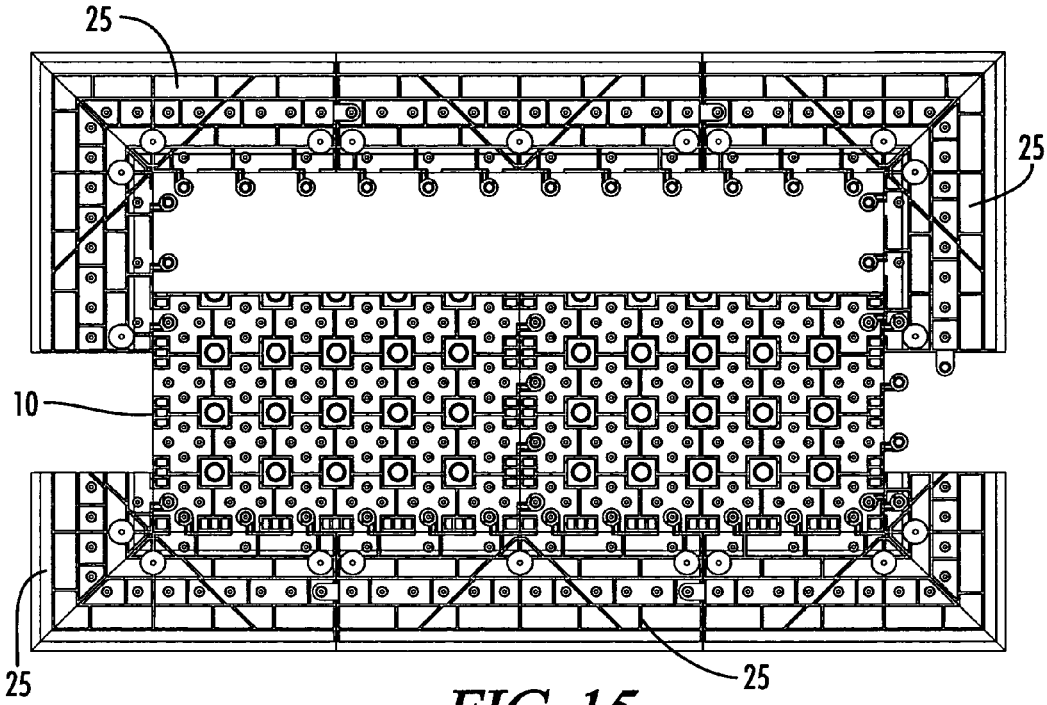
FIG. 15 shows a bottom view of a partial tile assembly that is ready to be complete by trimmed modular tiles of the present invention and trimmed transition tiles of the present invention.
Figure 16:
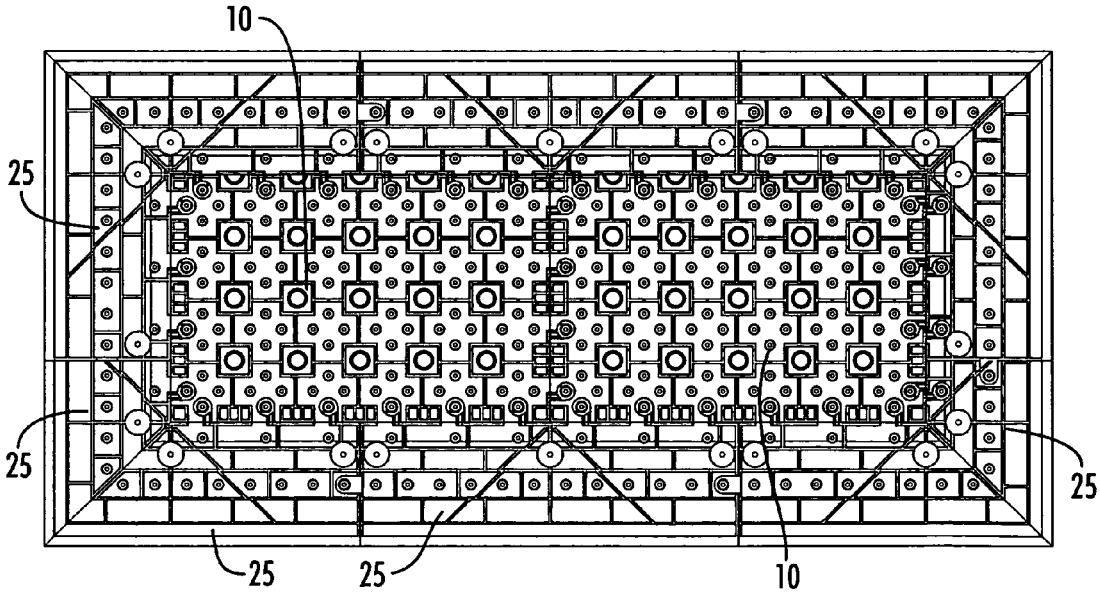
FIG. 16 is a bottom view of a completed interlocking tile system or assembly of the present invention.

Multiple tiles of the present invention including optional transition tiles may be interlocked to provide modular tile systems. FIGS. 8-10 and 13-19 show completed or partially completed modular tile systems. FIG. 8 shows a system with two modular tiles of the present invention and a transition tile 25. FIG. 9 shows an embodiment with two tiles 10 of the present invention bordered completely with transition tiles 25. In this embodiment, transition tiles are trimmed along diagonal tiles to snugly complete the border.

FIGS. 13-16 show how a trimmed tile 10 and/or trimmed transition tiles 25 may be used to complete a modular tile system.

Figure 17:
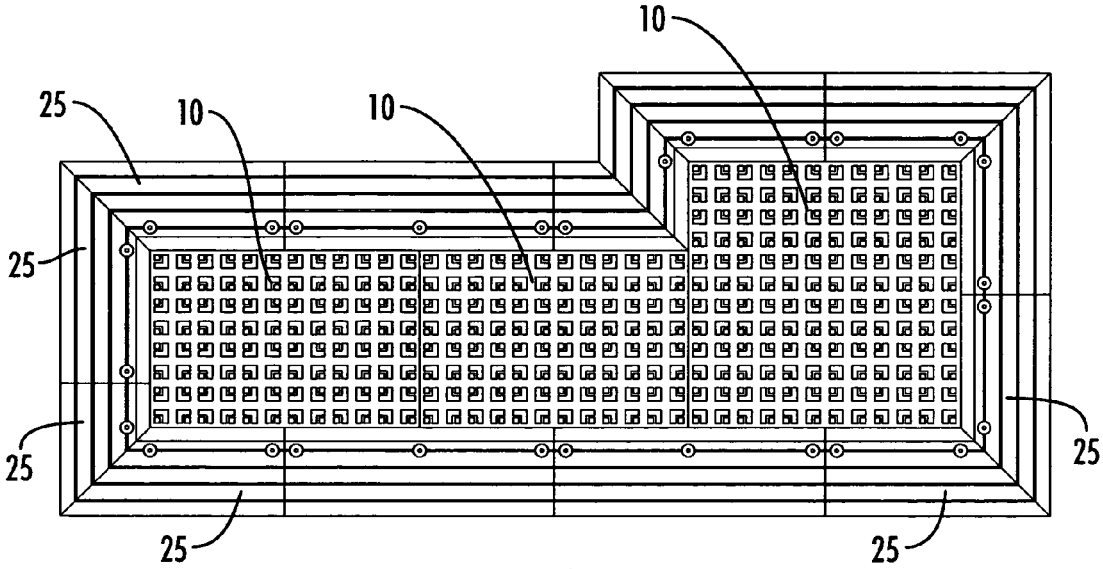
FIG. 17 is a top view of a completed tile system or assembly of the present invention that has a non-rectangular general shape. The tiles and transition tiles of this embodiment have been trimmed in order to provide said shape.
Figure 18:
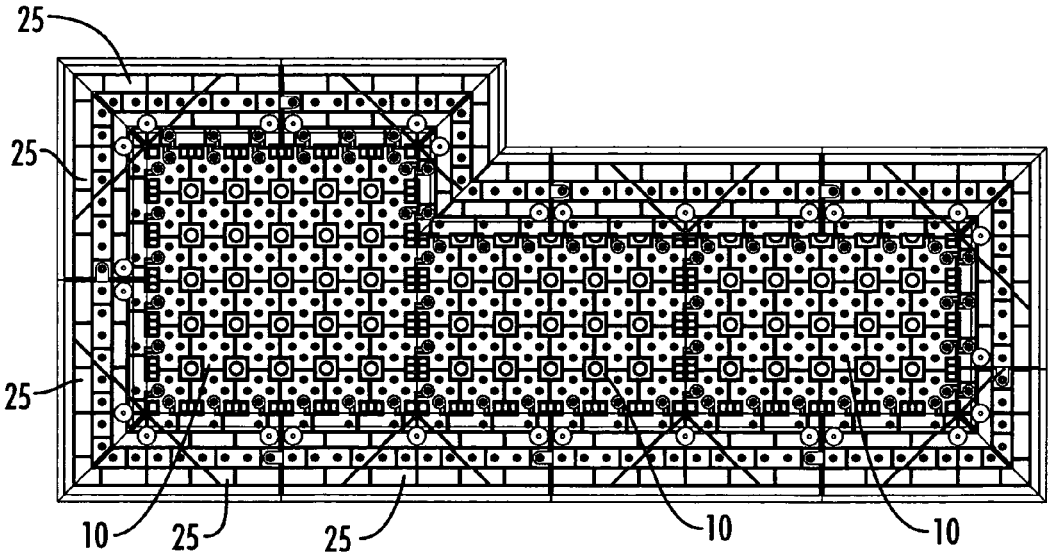
FIG. 18 is a bottom of view of the tile assembly of FIG. 17.
Figure 19:
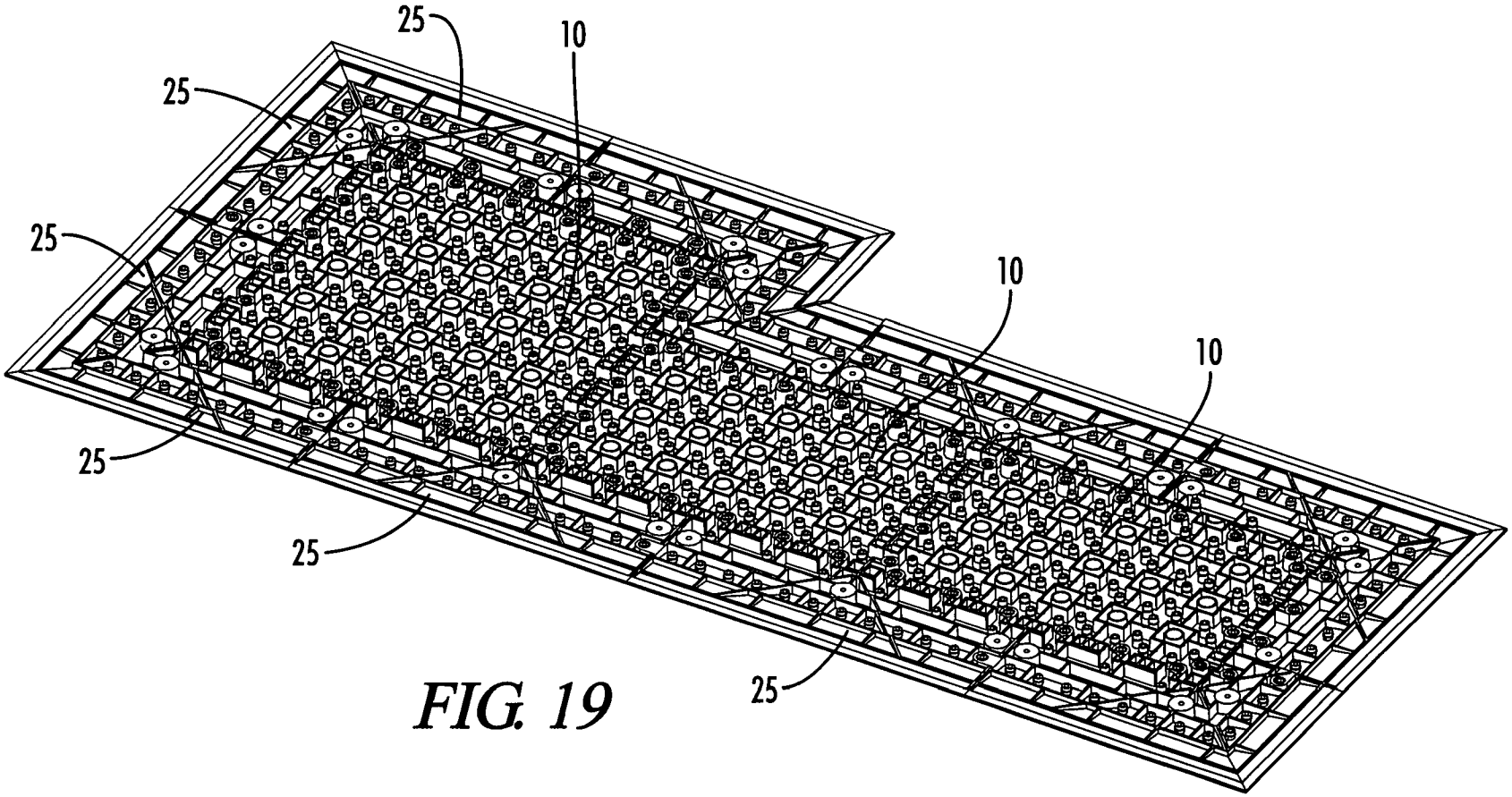
FIG. 19 shows a perspective bottom view of the tile assembly of FIG. 17.

FIGS. 17, 18 and 19 show how the modular tiles and transition tiles of the present invention may be used to form floor coverings of an irregular shape.

The invention thus being described, it is obvious that the same may be carried out in other specific ways than those herein set forth without departing from the spirit and essential characteristics of the invention. The present embodiments are, therefore, to be considered in all respects as illustrative and not restrictive and all changes as would be obvious to one of ordinary skill in the art and within the meaning and equivalency ranges of the claims are intended to be embraced therein.

Throughout this disclosure, various patents and publications are cited. All such patents and publications are incorporated herein by reference in their entirety.

Finally, unless otherwise indicated, all numbers expressing quantities or sizes are to be understood as being modified in all instances by the term "about." Accordingly, unless indicated to the contrary, the numerical parameters set forth in the specification and claims are approximations that may vary depending upon the desired characteristic sought.

We claim:

1. An interlocking, modular floor tile, comprising:

a planar member defined by a perimeter having four sides and a top surface, a plurality of downwardly projecting support legs of common length dispersed pattern-wise inside the perimeter of the planar member and coupled with the top surface, the support legs being positioned such that the tile can be trimmed to a desired size and maintain connectability with female interlocking connectors of a like tile, and at least one female interlocking connector element that extends outside the perimeter of the planar member for receiving a support leg of a like tile and thereby forming an interlock with the like tile;

the tile comprising a support grid coupled with the top surface of substantially common length as the projecting legs, so as to provide vertical support to the top surface.

2. The modular floor tile of claim 1, wherein the top surface comprises a pattern of ridges or elevations to increase friction on the surface of the tile.

3. The modular floor tile of claim 1, wherein the top surface defines a pattern of holes to allow the passage of air or a liquid.

4. The modular floor tile of claim 1, wherein multiple female interlocking connectors are positioned along two sides of the tile.

5. The modular floor tile of claim 1, wherein the tile further comprises cut lines or cut indicators perpendicular from said perimeter to assist in trimming the tile.

6. A modular floor tile for interconnecting with similar modular floor tiles, comprising:

a planar tile defined by a perimeter;

a ground-engaging support grid that downwardly projects from the tile;

a plurality of support legs of common length that are dispersed pattern-wise inside the perimeter and being coupled to the grid, the support legs having a substantially common length as the grid and being positioned such that the tile can be trimmed to a desired size and maintain connectability with female interlocking connectors of a like tile; and a plurality of female interlocking connector elements that extend outside the perimeter for receiving a support leg.

7. The modular floor tile system of claim 6, the support grid comprising intersecting cross members.

8. The modular tile of claim 6, wherein the support legs are ground-engaging to provide vertical support to the grid.

9. The modular tile of claim 6, wherein the support grid further comprises a top planar surface.

10. The modular tile of claim 9, wherein the top planar surface comprises a friction-promoting surface.

11. The modular tile of claim 6, wherein the support legs are resilient, impact-absorbing material.

12. The modular tile of claim 6, wherein each side is from about 15 inches to about 25 inches in length.

13. The modular tile of claim 6, wherein each side is from about 10 inches to about 30 inches in length.

14. The modular tile of claim 6, wherein the female connectors are positioned on one side of the perimeter of the planar surface, and the support legs are positioned on the opposite side of the perimeter to receive the female connectors of a like tile.

15. The modular tile of claim 14, wherein the support legs are positioned in at least one row.

16. The modular tile of claim 6, wherein the support legs are positioned throughout the perimeter.

17. The modular tile of claim 6, wherein the support legs are positioned in rows inside the perimeter.

18. A modular tile system of interlocking floor tiles, comprising:

at least two interlocked tiles, with each of said at least two interlocked tiles having a planar member that is defined by a perimeter having four sides and a width, the planar member having a downwardly projecting support grid and support legs of common length with the grid that are coupled to the planar member and pattern-wise dispersed within the perimeter of the planar member the support legs being positioned such that a tile can be cut along a line generally perpendicular to a perimeter side wall, and the support legs proximate to the cut are received by the interlock coupling devices of the adjacent tile forming a continuous, generally uniform displacement gap between a perimeter side of adjacent tiles; and at least one interlock coupling device that extends beyond said perimeter and snugly receiving a support leg of a second tile, forming a continuous, generally uniform displacement gap between the perimeters of adjacent tiles.

19. The modular tile system of claim 18, wherein the planar member comprises an upper surface.

20. The modular tile system of claim 19, wherein the support legs are pattern-wise coupled to the upper surface of the planar member.

21. The modular tile system of claim 18, wherein the planar member comprises:

a repeating pattern of intersecting cross support members extending inward from the perimeter wall and joined at cross junctions along a common plane.

22. The modular tile system of claim 18, wherein support legs are pattern-wise coupled to cross support members.

23. The modular tile system of claim 18, wherein the planar member comprises:

an upper surface defined by the perimeter having four sides, and a repeating pattern of intersecting cross support members extending inward from the perimeter wall and joined at cross junctions along a common plane in support of the upper surface.

24. The modular tile system of claim 23, wherein the support legs are pattern-wise coupled to the upper surface of the planar member.

25. The modular tile system of claim 18, wherein the support grid comprises:

an upper surface defined by the perimeter having four sides, and a repeating pattern of intersecting cross support members extending inward from the perimeter wall and joined at cross junctions along a common plane with interstitial openings formed therebetween.

26. The modular tile system of claim 18, wherein the displacement gap is less than about 1 mm.

27. The modular tile system of claim 18, wherein interlock coupling devices are positioned along two sides of the perimeter, thus providing a planar member having two sides with interlock coupling devices and two sides that lack interlock coupling devices.

28. The modular tile system of claim 18, further comprising:

at least one transition tile to provide an angled transition between a floor and the width of the support grid perimeter.

29. The modular tile system of claim 28, wherein the transition tile comprises a perimeter that comprises a tile system-adjacent side and a floor-transition side, with the tile system-adjacent side comprising support legs of common length distributed pattern-wide adjacently thereto, and female connectors extending beyond the portion of the perimeter defined by the tile system-adjacent side.

30. The modular tile system of claim 29, wherein the female connectors extending beyond the portion of the perimeter defined by the tile-system adjacent side are removable to allow the support legs of the transition tile to be attachable to female connectors of an adjacent tile.

31. A transition tile for a modular tile system, comprising:

a tile having a perimeter defined by a top surface, first, second, third, and forth side;

a female connector extending beyond the perimeter of the first side of the perimeter;

support legs coupled with the top surface and dispersed pattern-wise from the first side to an opposite third side to receive a female member of a corresponding transition tile to form a snug interlock, the support legs being positioned such that the tile can be trimmed to a desired size and maintain connectability with female interlocking connectors of a second tile; and a downwardly extending, ground-engaging support grid.

32. The transition tile of claim 31, further comprising at least one of:

a male support leg along the second side of the perimeter, which borders and forms an interlock with a modular tile; and a female connecting element extending outside the second side of the perimeter, which borders and forms an interlock with a modular tile.

33. The transition tile of claim 31, further comprising countersink holes.

34. The transition tile of claim 31, wherein the height of the second side of the perimeter about the same as the height of a bordering tile, and the height of the fourth side of the perimeter opposite the second side is a lesser height, providing an angled transition from the floor to the tile.

35. The transition tile of claim 31, wherein the top surface comprises a support grid.

36. The transition tile of claim 35, wherein the support grid comprises diagonal cross members.

37. A method of constructing an interlocking tile floor covering, comprising:

selecting at least two floors tile with a planar member, defined by a perimeter having four sides, a plurality of support legs of common length dispersed pattern-wise throughout and coupled with the member, at least one female interlocking connector element that extends outside the perimeter of the planar member for receiving a support leg and thereby forming an interlock, the planar member having a downwardly extending, ground-engaging support grid;

interlocking said tiles by coupling the female connectors with a corresponding support leg;

trimming a floor tile to correspond with the desired area desired to be covered, thus forming a trimmed floor tile;

interlocking a support leg of the trimmed tile with a corresponding female interlocking connector of another tile.

* * * * *